US009833043B2

(12) United States Patent
Ganci

(10) Patent No.: US 9,833,043 B2
(45) Date of Patent: Dec. 5, 2017

(54) SHOE GARTER

(71) Applicant: Melisa M Ganci, Brooklyn, NY (US)

(72) Inventor: Melisa M Ganci, Brooklyn, NY (US)

( * ) Notice: Subject to any disclaimer, the term of this patent is extended or adjusted under 35 U.S.C. 154(b) by 0 days.

(21) Appl. No.: 14/973,630

(22) Filed: Dec. 17, 2015

(65) Prior Publication Data

US 2017/0172256 A1 Jun. 22, 2017

(51) Int. Cl.
*A43C 15/02* (2006.01)
*A43C 11/14* (2006.01)

(52) U.S. Cl.
CPC ..... *A43C 11/1493* (2013.01); *A43C 15/02* (2013.01)

(58) Field of Classification Search
CPC ..... A43C 11/1493; A43C 15/00; A43C 15/02; A43B 23/28
USPC ..... 36/62
See application file for complete search history.

(56) References Cited

U.S. PATENT DOCUMENTS 430,982 A * 6/1890 Ziegler ..... A43B 23/28 36/58.5
1,252,149 A * 1/1918 Muse ..... A43B 23/28 36/58.5
1,385,328 A * 7/1921 Loudenslager ..... A43C 11/22 2/245
1,483,192 A * 2/1924 Langgons ..... A41F 9/002 2/338
1,655,715 A * 1/1928 Sneeston ..... A43C 11/02 36/58.5
1,794,959 A * 3/1931 Howard ..... A43C 11/22 36/58.5
3,000,119 A * 9/1961 Altman ..... A43C 11/00 24/3.2
4,702,021 A * 10/1987 Cameron ..... A43C 15/063 36/59 R
5,943,792 A * 8/1999 Powell ..... A43C 15/06 15/227
7,398,607 B1 * 7/2008 Garcia ..... A43B 1/0072 36/101
7,614,126 B2 * 11/2009 Gerhardt ..... A43B 3/126 24/712
2006/0156586 A1 * 7/2006 Brunelle-Wright .... A43B 3/122 36/89
2007/0130800 A1 * 6/2007 Twomey ..... A43B 3/16 36/50.1
2010/0299960 A1 * 12/2010 Nyamuswa ..... A43C 11/24 36/89
2011/0225850 A1 * 9/2011 Shen ..... A43B 3/126 36/136
2013/0205476 A1 * 8/2013 Gentile ..... A41F 1/08 2/311

(Continued)

*Primary Examiner* — Ted Kavanaugh
(74) *Attorney, Agent, or Firm* — Sonya C. Harris; Invention Services

(57) ABSTRACT

A shoe garter configured and designed to secure a shoe to a user's foot. The shoe garter device comprises a flexible strap with fastening means to secure the shoe garter about the shoe and foot of the wearer. The shoe garter device further comprises gripping member on the inner side for frictionally securing the garter to a shoe. The shoe garter may also be adapted and configured to comprise one or more designs, decorative elements, and/or indicia, for varying the decorative appearance and providing different styles to the shoe garter. Typically, the fastening means may comprise hook and loop type fasteners.

7 Claims, 4 Drawing Sheets

(56) References Cited

U.S. PATENT DOCUMENTS

| | | | | |
|---|---|---|---|---|
| 2014/0259763 | A1* | 9/2014 | Rady | A43B 21/00<br>36/58.5 |
| 2016/0338448 | A1* | 11/2016 | Kenison | A43C 11/14 |

* cited by examiner

SHOE GARTER

FIELD OF INVENTION

The present disclosure relates generally to a shoe garter device for securing a shoe on a wearer and also providing a decorative ornament about the shoe.

BACKGROUND

Often times women or men find that shoes or other footwear devices have a tendency to slip off the back of the wearer's heels when walking. Specifically, women often become frustrated with high heel shoes when the heel portion of the shoe continuously slips off the back of the wearer's heel. The continuous slippage can make it difficult for the wearer to function in the shoes, and can cause chafing or blisters to form on the wearer's heels resulting in discomfort or further irritation. Additionally, continuous slippage can also cause the wearer to fall or become injured. Also, if the shoe or other footwear device slips off, there is a possibility that the heel of the shoe will break off. Further, many women purchase shoes solely because they have straps, even if the shoes are not their desired design choice option. Some wearers of the shoes may want to further decorate the shoes to accentuate the design of the shoe. Consequently, an effective solution is necessary.

There is a need for a shoe garter strap that is designed to secure a shoe to a user's foot, and that prevents continuous slippage. The present invention discloses a shoe garter device designed to secure a shoe to a user's foot. The shoe garter device can be used to secure stiletto heels, pumps, wedges, mules, and any other type of shoe that does not have adequate support over the top of the foot. Further, the shoe strap device of the present invention comprises an adjustable strap that can be clipped about the shoe to ensure that the user's foot does not slip out of the shoe, which prevents or reduces the likelihood of injury. Anyone that has shoes or other footwear devices which have a tendency to slip off the back of their heels when walking will appreciate the security and comfort that this invention affords. Anyone wishing to augment the look of the pair of shoes being worn would also appreciate the decorative features that this invention affords.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a shoe garter device designed to secure a shoe to a user's foot. The shoe garter device comprises a flexible strap with fastening means to secure the shoe garter about the shoe and foot of the wearer. The shoe garter device further comprises gripping member on the inner side for securing the garter to a shoe. Typically, the fastening means may comprise hook and loop type fasteners.

Accordingly, it is an object of the present invention to provide a shoe garter strap device that is designed to secure a shoe to a user's foot, and that prevents continuous slippage.

In accordance with an aspect of the present disclosure, there is disclosed a shoe garter device that can be used to secure various types of shoes including stiletto heels, pumps, wedges, mules, and any other type of shoe that does not have adequate support over the top of the foot.

In accordance with yet another aspect of the present disclosure, there is disclosed a shoe garter device that reduces the likelihood of injury of the wearer of shoes by securing the shoes on the feet better.

In accordance with yet another aspect of the present disclosure, there is disclosed a shoe garter device, which can further decorate the shoes to accentuate the design of the shoe.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

BRIEF DESCRIPTION OF THE DRAWINGS

Embodiments of the present disclosure are described herein with reference to the drawings, in which.

The novel features which are characteristic of the invention, as to organization and method of use, together with further objects and advantages thereof, will be better understood from the following disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has". The term set has the meaning of one or more of said element. Furthermore, any use of the term "or" as used herein is generally intended to mean "and/or" unless otherwise indicated. Combinations of components or steps will also be considered as being noted, where terminology is foreseen as rendering the ability to separate or combine is unclear.

DETAILED DESCRIPTION

Figure 1:
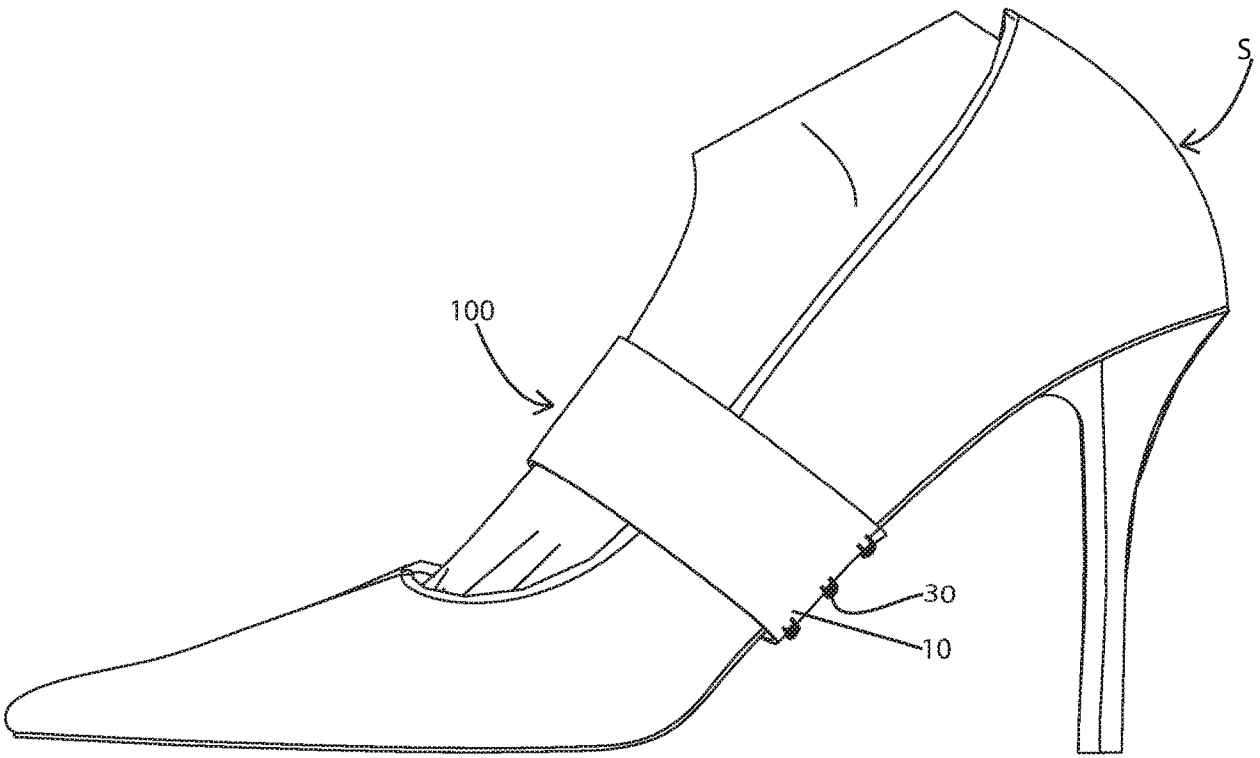
FIG. 1 is a side perspective view of the shoe garter device worn about a shoe in accordance with an embodiment of the present invention.

Referring now to the drawings, FIG. 1 is a side view of the shoe garter 100 being worn about the shoe S, of a wearer.

Figure 2:
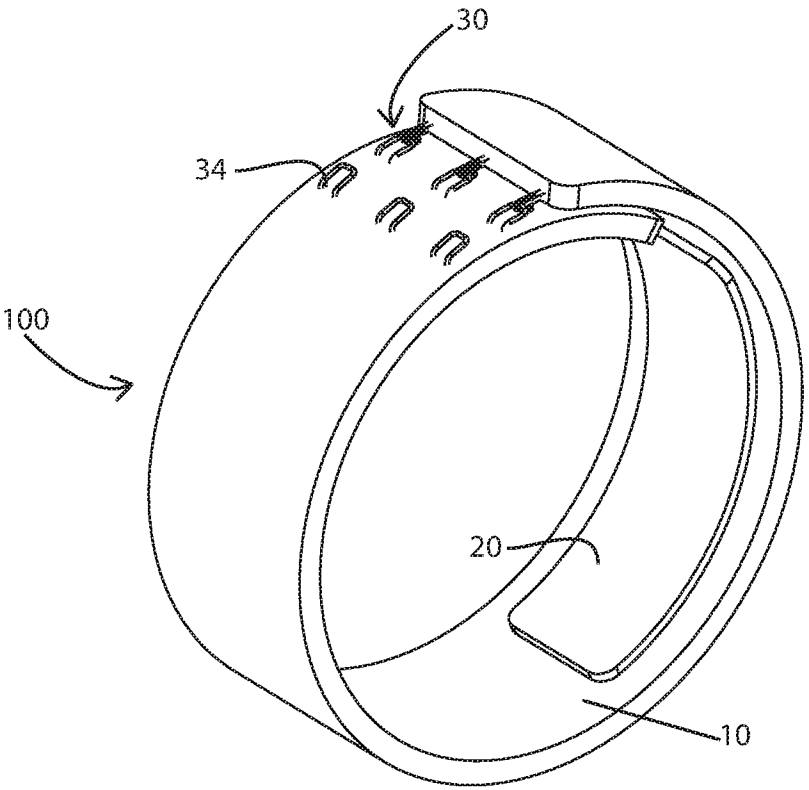
FIG. 2 is a top perspective diagram illustrating the shoe garter device in a closed position in accordance with an embodiment of the present invention.
Figure 3:
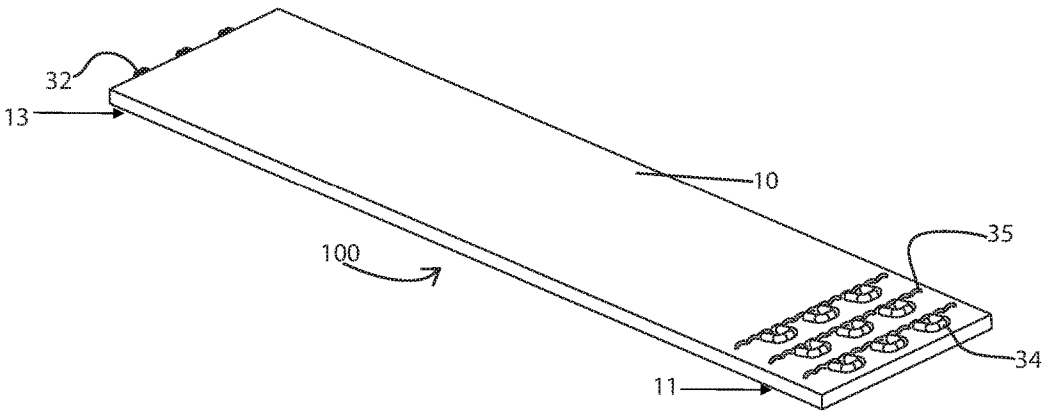
FIG. 3 is an elevational diagram of the outer side of the shoe garter device in an opened position in accordance with an embodiment of the present invention.
Figure 4:
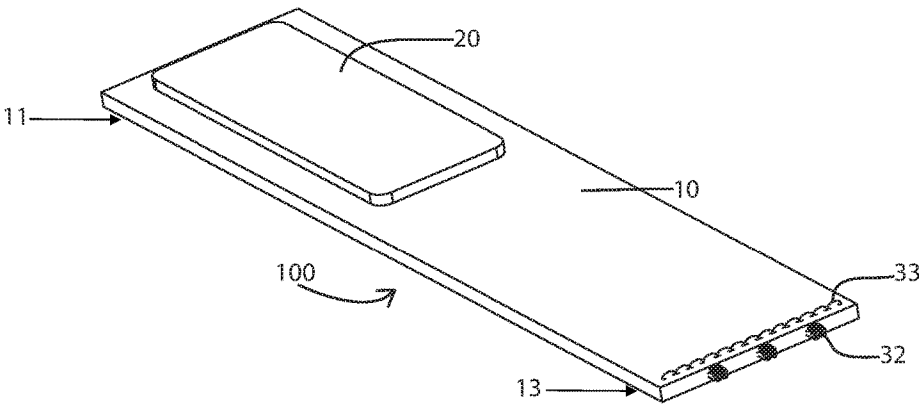
FIG. 4 is an elevational diagram of the inner side of the shoe garter device in an opened position in accordance with an embodiment of the present invention.
Figure 5:
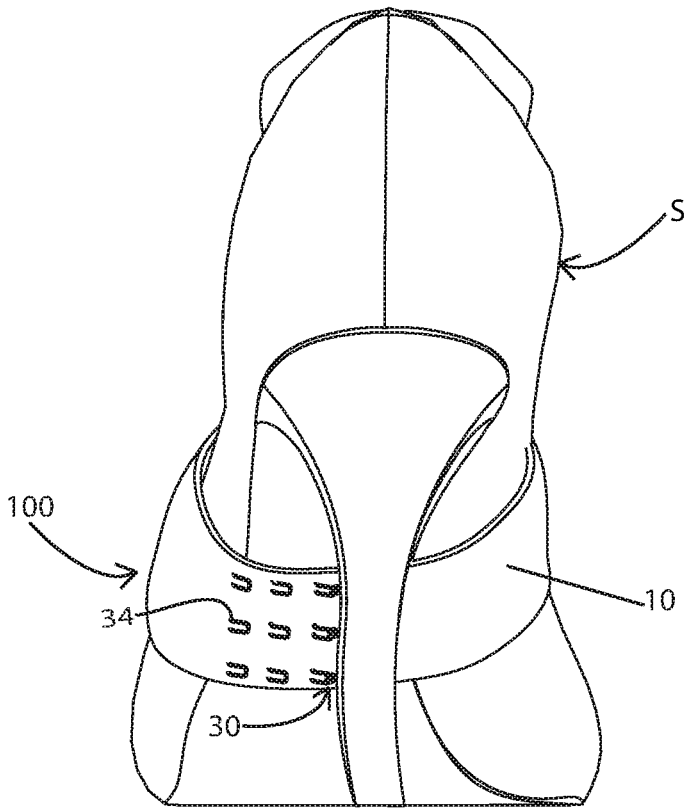
FIG. 5 is a rear view perspective view of the shoe garter device worn about a shoe in accordance with an embodiment of the present invention.

FIGS. 1, 2 and 5 illustrate the shoe garter 100 is illustrated in a closed position being secured by fastening means 30. FIGS. 3 and 4 show a diagram of the shoe garter 100 in an opened position with the outer side 14 facing up, as shown in FIG. 3; and the inner side 12 facing up in FIG. 4. As shown in the figures, shoe garter 100 is comprised of fastening means 30 on both ends of the shoe garter 100. The shoe garter 100 is primarily comprised of a unitary rectilinear flexible strap 10 having fastening means 30 on both ends, and a gripping member 20.

As shown in FIG. 3, the outer side 14 has a set of loop fasteners 34 attached to the distal end 11 thereof, and a set of corresponding hook fasteners 32 on the proximal end 13 thereof (see also FIG. 4). In one embodiment, the set of male hook fasteners 32 are adapted and configured such that they matingly connect with corresponding and respective female loop fasteners 34 securing the closure of the fastening means 30 bringing both the proximal and distal ends together to thereby close the shoe garter 100, as best seen in FIG. 2.

The fastening means 30 may comprise a set of one or more strips of female loop fasteners 34, as shown in FIG. 3, which facilitates adjustable connecting lengths of the shoe garter 100 when the fastening means 30 are matingly fastened. For example, in one embodiment, three strips of female loop fasteners 34 may be provided in a row-like fashion having a first, second and third row. And, as shown in FIG. 2, the male hook fasteners 32 may matingly connect to the female loop fasteners 34 at the second row; and as shown in FIG. 5 (worn about the shoe S) the male hook fasteners 32 may matingly connect to the female loop fasteners 34 at the first row. The fastening means 30 may be bonded by way of suitable bonding methods known to artisans having ordinary skill in the art, such as chemical, thermal, and or mechanical bonding means.

The gripping member 20 is bonded to the interior inner side 12 of the flexible strap 10 such that when the shoe garter 100 is in a closed position (see FIGS. 1, 2, and 5) the gripping member 20 is in a secured circumferential contact with the shoe S and the wearer, to thus provide a friction contact surface to keep the shoe garter 100 and the shoe S in place about the foot of the wearer. The gripping member 30 may be bonded by way of suitable bonding methods known to artisans having ordinary skill in the art, such as chemical, thermal, and or mechanical bonding means. Such bonding means including, but not limited to adhesive bonding agents, heat sealing processes, and mechanical attachment methods. Such bonding means including, but not limited to adhesive bonding agents, heat sealing processes, mechanical attaching such as stitching, crimping, fastening. These include any variety of bonding solutions, or thermal bonding processes, or mechanical attachment means, or any combinations thereof. In one embodiment, an exemplary dimension of the thickness of the gripping member 20 may be in the range of approximately 2.5 mm to 5.0 mm and covering at least one quarter to one half of the length of flexible strap 10.

The flexible strap 10 may be comprised of any suitable durable material that is flexible and durable. This flexible strap 10 may consist of one or more sub-layers of one or more material fabrics to provide structural support for encasing the shoe S when worn. The fabric may be synthetic or natural fiber structures, or blends thereof. Synthetic fiber structure refers to a fiber structure created from man-made materials such as petroleum distillates or regenerated or modified cellulosic materials. In most instances, synthetic fiber structures generally have a fiber length greater than about 0.01 meter. Examples of a synthetic fiber structure include nonwoven webs having petroleum distillate fibers, or semi-synthetic regenerated cellulosic fiber structures, such as products sold under the trade designation RAYON®. Natural fibers are textile fibers of mineral, plant, or animal origin. The more common natural fibers include cotton, wool, linen, hemp, and ramie.

The flexible strap 10 may also be adapted and configured to comprise one or more designs, decorative elements, and/or indicia, as well as one or more colors, for varying the decorative appearance and providing different styles to the shoe garter 100. The flexible strap 10 may be sized and dimensioned to encase different sizes and types of shoes S. The length and width of the rectilinear flexible strap 10 are dimensioned such that the length is greater than the width and may be sized and dimensioned into a small, medium and large sizes—and the varying width sizes may be referred to as the ballerina sized strap (small), the Mary Jane sized (medium), or the grande (large) sized. The varying width sizes add a stylistic flair to the shoe garter 100 as it is worn about the shoe S.

In one embodiment, the dimension for the flexible strap 10 may be approximately 9 inches in length while having the varying small, medium and large width sizes. In one embodiment, the width of the small size is approximately ½ inch; and the medium size width is approximately one inch; and the large width size is approximately 1½ inch. In another embodiment, where the shoe garter 100 may not only extends about the shoe but also crisscross and extend about the ankle in an ankle strap, the flexible strap 10 would have a length approximately 3 times its length falling in a range of about 19-21 inches.

It is to be appreciated that one or more of the elements depicted in the drawings/figures can also be implemented in a more separated or integrated manner, or even removed or rendered as inoperable in certain cases, as is useful in accordance with a particular application. Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth.

Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure.

For example, the shoe garter 100 may be comprised of a unitary part, however it is understood that as a manufacturing and/or design consideration that they may be comprised of one or more sections to make the whole. Moreover, the gripping member 20 may be a unitary structure or may be a set of strips as opposed to just one single member. In some embodiments, the gripping member 20 may extend about the entire interior side 12 of the shoe garter 100. The set of hook and loop fastening means 30 may be comprised of any other suitable fastening means including but not limited to Velcro hook and loop fastening strip(s), or other attaching means such as snaps or buttons and the like. Furthermore, the configuration of the female loop fasteners 34 may comprise one or more strips which need not be in a row-like fashion, but rather any other configuration (non-linear, etc) so long as the corresponding male hook fasteners 32 are adapted and configured to mate therewith.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

What is claimed is:

1. A shoe garter for wearing about the foot and shoe of a wearer, comprising:

a flexible strap, said strap having a length and a width with said length longer than said width forming a rectilinear shape, said strap having an interior side and an exterior side, and a proximal end located opposite a distal end;

a gripping member [located on] affixed to the distal end of said interior side of said flexible strap; and a first set of attachment means comprising a set of at least three rows of female loop fasteners attached to the distal end of said flexible strap, and wherein each row contains at least three female loop fasteners, and wherein each said row comprises at least three female loop fasteners; and, a second set of attachment means comprised of a row of male hook fasteners attached to the most proximal end of said flexible strap said first and second attachment means located on opposite ends of said flexible straps and adapted for matingly connecting to one another forming an adjustable strap, said female loop fasteners and said male hook fasteners adapted and configured for matingly connecting thereto in a circular manner thus fastening the flexible strap about the foot and shoe of a wearer circumferentially.

2. The shoe garter of claim 1, wherein said gripping member is bonded to the distal end of said flexible strap and frictionally securing said flexible strap in place when said female loop fasteners and said male hook fasteners are matingly connected.

3. The shoe garter of claim 2, wherein said array of female loop fasteners comprise a plurality of loops located at varying distances from one another and the distal end providing adjustable fitting of said flexible strap when matingly connected to said male hook fasteners.

4. The shoe garter of claim 3, wherein said flexible strap sized and dimensioned with a length of approximately 9 inches.

5. The shoe garter of claim 4, wherein said flexible strap sized and dimensioned as a small width size of approximately one half inch wide.

6. The shoe garter of claim 5, wherein said flexible strap sized and dimensioned as a medium width size of approximately one inch wide.

7. The shoe garter of claim 6, wherein said flexible strap sized and dimensioned as a large width size of approximately one and a half inch wide.

* * * * *